US007243447B1

(12) United States Patent
Springer

(10) Patent No.: US 7,243,447 B1
(45) Date of Patent: Jul. 17, 2007

(54) IRONING BOARD EXPANSION PLATFORM

(76) Inventor: Nigel Anthony Springer, 2900 NW. 48th Ter., Apartment #203, Lauderdale Lakes, FL (US) 33313

( * ) Notice: Subject to any disclaimer, the term of this patent is extended or adjusted under 35 U.S.C. 154(b) by 0 days.

(21) Appl. No.: 11/456,727

(22) Filed: Jul. 11, 2006

Related U.S. Application Data

(63) Continuation-in-part of application No. 11/161,228, filed on Jul. 27, 2005, now Pat. No. 7,096,613.

(51) Int. Cl.
*D06F 81/12* (2006.01)
*A47B 1/04* (2006.01)
*D06F 81/00* (2006.01)

(52) U.S. Cl. ..... 38/135; 108/69

(58) Field of Classification Search ..... 38/135, 38/137, 140, 107, 138; 108/11, 13, 17, 56.3, 108/57.31, 69, 90, 102, 180; 297/135
See application file for complete search history.

(56) References Cited

U.S. PATENT DOCUMENTS 584,505 A * 6/1897 Harrigan ..... 38/135
2,803,897 A * 8/1957 Miyamoto ..... 38/137
2,999,325 A * 9/1961 Munson et al. ..... 38/140
3,045,373 A * 7/1962 Olswang ..... 38/137
3,148,914 A * 9/1964 Steely ..... 297/149
5,016,367 A * 5/1991 Breen et al. ..... 38/135
6,286,237 B1 * 9/2001 Toutounchian ..... 38/107
6,907,829 B2 * 6/2005 Bambach et al. ..... 108/65
7,096,613 B1 * 8/2006 Springer ..... 38/138

* cited by examiner

*Primary Examiner*—Ismael Izaguirre
(74) *Attorney, Agent, or Firm*—Jerry D. Haynes, P.A.

(57) ABSTRACT

The present invention relates to a platform assembly and method that expands the surface area of a conventional ironing board. The platform assembly covers a converging end of an ironing board and expands the surface area of the ironing board. The platform assembly of the present invention includes parabolic shaped outer edges that provide a configuration especially useful in the ironing of shirts. A user may easily remove and store the platform assembly in order to convert the ironing board back to its original form.

8 Claims, 16 Drawing Sheets

IRONING BOARD EXPANSION PLATFORM

CROSS REFERENCE TO RELATED APPLICATIONS

The present application is a continuation in part of U.S. patent application Ser. No. 11/161,228, filed Jul. 27, 2005 now U.S. Pat. No. 7,096,613 (entitled "IRONING BOARD EXPANSION PLATFORM").

BACKGROUND OF THE INVENTION

1. Field of the Invention

The present invention relates to a device that expands the ironing surface on a conventional ironing board.

2. Description of Related Art

Ironing boards have been in use over many years in order to facilitate the crisp, fresh, wrinkle-free look to clothing adorned by many. The general purpose of ironing is readily evident. The ironing board allows the user to lay clothing for application of heat via an iron in order to smooth wrinkles to achieve the desired look. The iron board shape has remained consistent over the years where one end includes three sides at about 90 degrees from each other and the other end converging to a curved point. A top view of a conventional ironing board is shown in FIG. 1A. Ironing board 15 includes a straight edge 17 with side edges 18*a*, 18*b* that extend forward to the converging end 19. The top surface of board 15 provides an ironing surface for the user. Although the shape of the ironing board 15 apparently has been used quite extensively, the ironing board 15 presents some shortcomings to the user, mainly when ironing articles of clothing, the user may have to reposition clothing on the board several times to complete the task of ironing.

Ironing a shirt or a blouse requires multiple positioning during the ironing process. Furthermore, even when the user repositions the clothing, the user may be unable to reach certain areas or occasionally the repositioning may be ineffective in providing the user with the necessary area to complete the ironing task. A conventional shirt or blouse may include a large flat area, typically the back side, in order to iron this area the user must continually reposition the shirt. This repositioning becomes even more tedious around the shoulder and armpit areas. The constant flipping or repositioning of the shirt inevitably causes problems in completing the task of ironing. Furthermore, each reposition of the iron process may necessitate that the user reposition and re-iron certain areas in order to have a completely ironed and wrinkle-free shirt.

The prior art contains various variations of the conventional ironing board in order to address some of these problems. One piece of prior art which shows a modification of conventional ironing boards is U.S. Pat. No. 6,151,817 to Eiben (Eiben reference). The Eiben reference relates to an ironing board that possesses two end sections that extend side by side wherein one section provides an area for ironing clothing and a narrow section is provided to iron shirt sleeves where the two sections are separated by a gap. The Eiben reference discusses a modification to the conventional ironing board, however, it does not address the requirement of maneuvering a shirt over the surface in order to complete the ironing process.

Another prior art reference that includes modifications to the conventional ironing board is U.S. Pat. No. 5,016,367 to Breen, et al. (Breen reference). The Breen reference relates to an iron board that includes a main board and two swingable board extensions that are retractably attached to the main board. The extensions and main board of the Breen reference provide for the ironing of trouser legs and sleeves on the narrow portions thereof. The Breen reference, again, fails to address each area that a shirt may possess and, thus, still facilitates a process that requires a significant amount of flipping of the article of clothing.

U.S. Pat. No. 6,286,237 to Toutounchian relates to a multiple function ironing board which has various periphery attachments to help facilitate the ironing process. The multiple attachments attempt to expand the surface area at one end of the ironing board and to provide for multiple iron resting plates at the opposite end thereof. The drawback of the Toutounchian reference is that it includes multiple attachments and, therefore, makes for a fairly cumbersome ironing board assembly.

The prior art lacks any versatility or capability to expand a conventional board as used throughout the consumer market. Accordingly, consumers need an optional attachment that enables the expansion of the iron board surface area that could be easily attached and removed from a conventional ironing board. Such an attachment could easily be implemented into the current consumer market for ironing boards.

SUMMARY OF THE INVENTION

The present invention relates to a platform assembly and method that expands the surface area of a conventional ironing board. The platform assembly easily connects to an ironing board through the insertion of the converging end of the ironing board to a cavity on the bottom side of the platform assembly. The platform assembly covers the converging end and expands the surface area of the ironing board. The user may first remove the ironing board's pad and cover, or the platform assembly may be conveniently secured to the ironing board with pad and cover intact. The platform assembly may be secured to the ironing board by using a strap or cross member. The platform assembly comprises two wing portions and a platform that are assembled to form a platform assembly for use with any conventional application. The platform assembly has parabolic shaped outer edges that provide a configuration especially useful in the ironing of shirts. A user may easily remove and store the platform assembly in order to convert the ironing board back to its original form. It is therefore an object of the present invention to provide an expansion platform assembly comprising: a first wing portion, where the first portion includes a substantially parabolic upper outer edge and a curved inner edge said; a second wing portion, where said second portion includes a substantially parabolic upper outer edge and a curved inner edge; a platform, said platform having symmetrical substantially parabolic upper outer edges, said platform having a top side and a bottom side, where said first wing portion and second wing portion are affixed to the bottom side of said platform, where said outer edge of said platform aligns with said outer edge of each wing portion; and a cavity, where said cavity lies between the first wing portion, the second wing portion and the bottom side of said platform.

It is also an object of the present invention to provide a method for expanding the area of an ironing board surface comprising the steps of: creating a first wing portion, where the first wing portion includes an upper parabolic outer edge; creating a second wing portion, where the first wing portion includes an upper parabolic outer edge; aligning the outer edge of the first wing portion with an outer edge of a platform; aligning the outer edge of the second wing portion with the outer edge of the platform; affixing the first wing portion and the second wing portion to a bottom side of the platform, wherein the step of affixing creates a platform assembly; and securing the platform assembly onto a converging end of a ironing board.

It is also an object of the present invention to provide a method for expanding the area of an ironing board surface comprising the steps of: lying a shirt across a flat surface; sketching an outline along the outside edges of said shirt, where said outline creates a template; using the template to create a first wing portion, a second wing portion and a platform; affixing the first wing portion and second wing portion to a bottom side of the platform, where the other edges of the each wing portion aligns with the outer edge of the platform wherein the step of affixing creates a platform assembly; and securing the platform assembly onto a converging end of a ironing board.

In accordance with these and other objects which will become apparent hereinafter, the instant invention will now be described with particular reference to the accompanying drawings.

DETAILED DESCRIPTION

Figure 1A:
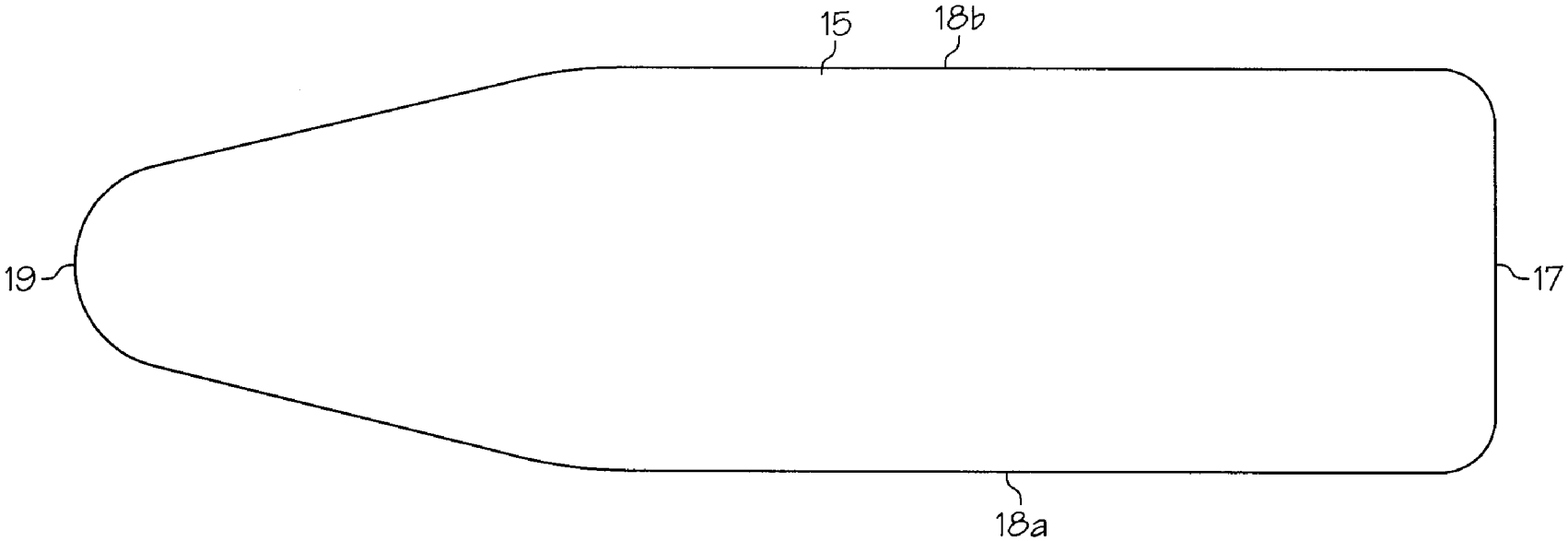
FIG. 1A (PRIOR ART)
FIG. 1A shows a top surface area of a conventional ironing board.
Figure 1B:
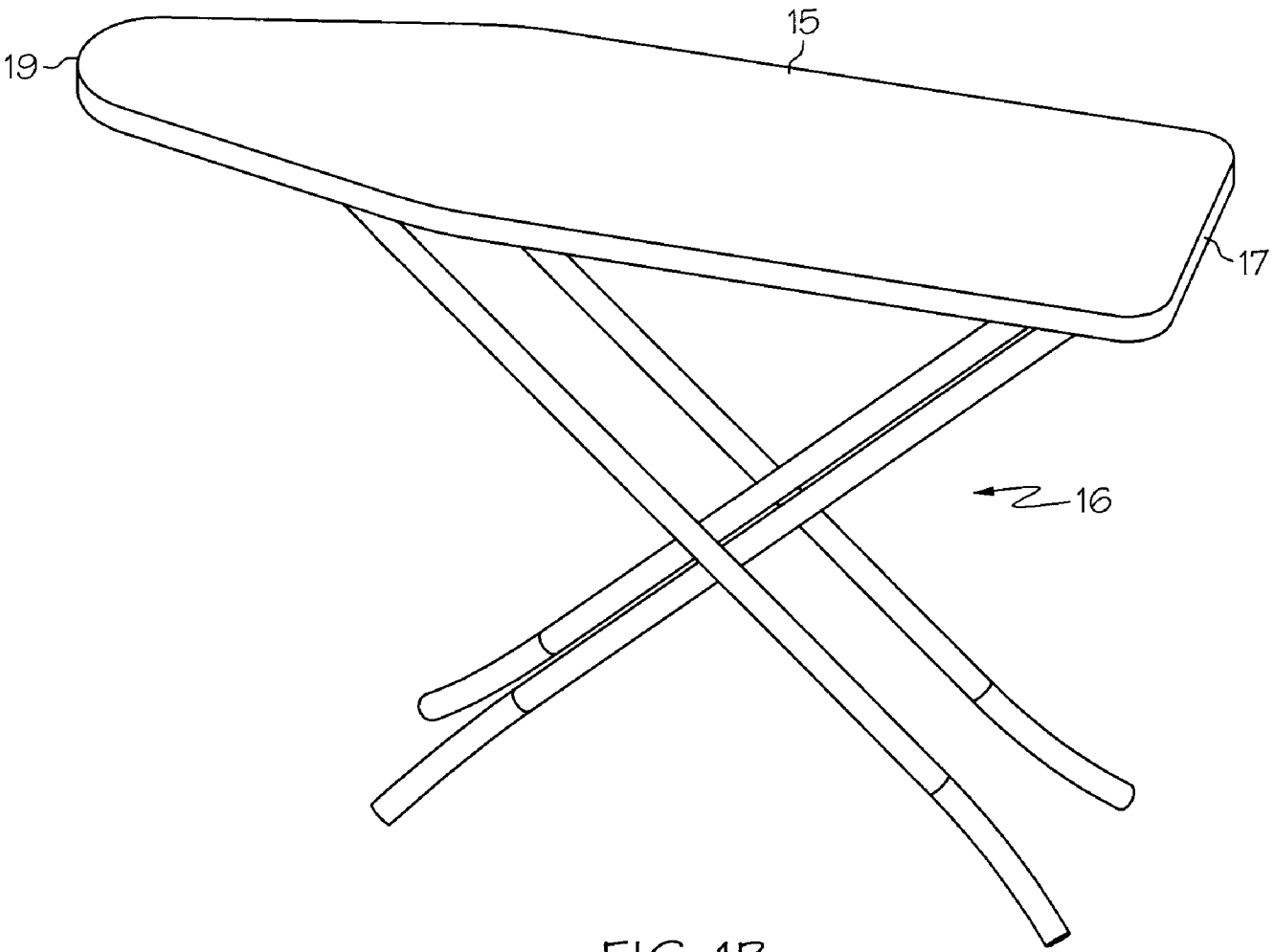
FIG. 1B (PRIOR ART)
FIG. 1B shows a perspective view of a conventional ironing board.

FIG. 1A shows a top view of a conventional ironing board 15. FIG. 1B shows a perspective view of the ironing board 15. Sides 18*a* and 18*b* extend from a straight edge 17 to converging edge 19. The conventional ironing board 15 usually is supported upon folding legs 16 that allow for easy storage of ironing board 15. However, some ironing boards may be stored in a wall or closet and may extend from the wall along with supporting members. Regardless of support means, ironing boards usually have the shape as shown in 1A and 11B.

Figure 2:
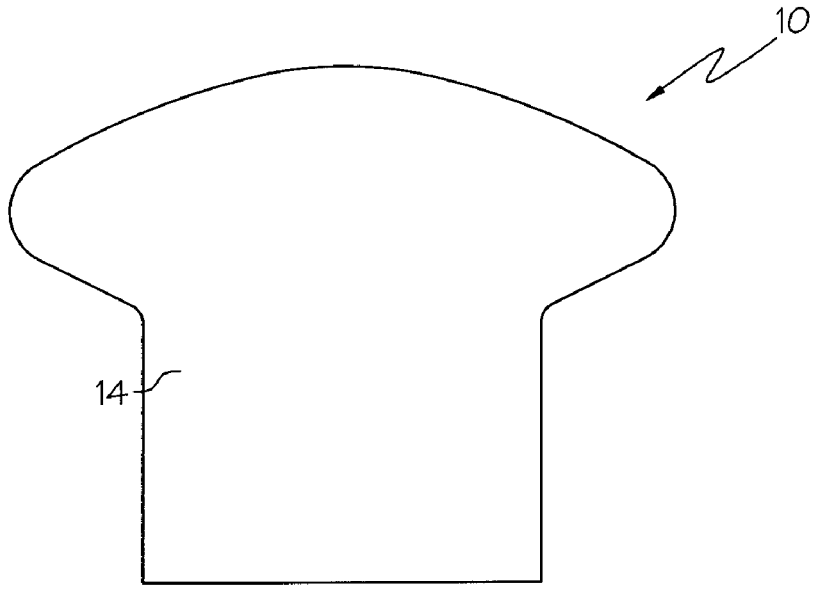
FIG. 2 shows a top surface of a platform assembly according to the present invention.
Figure 3:
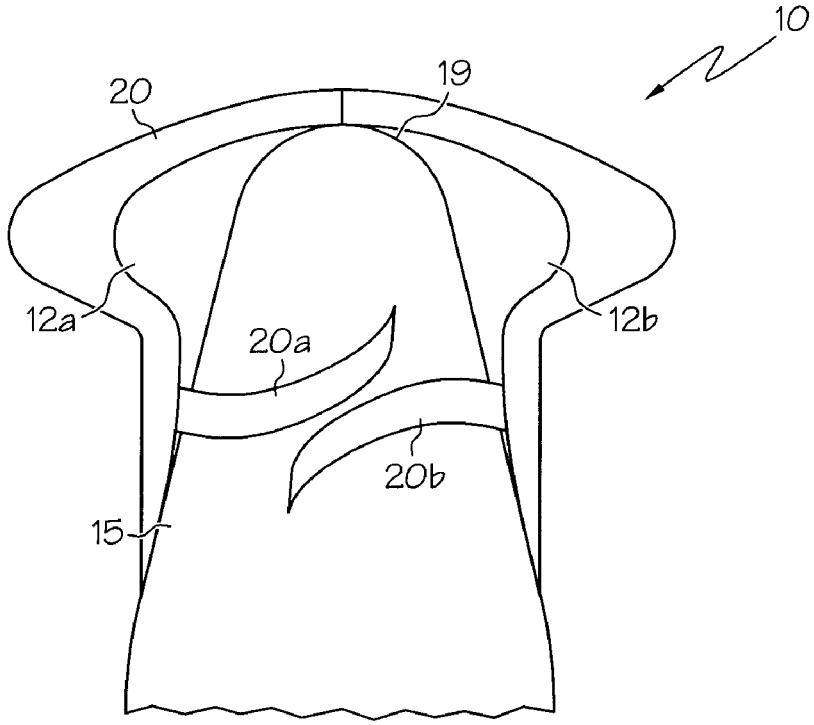
FIG. 3 shows a bottom view of the platform assembly attached to a conventional ironing board.

FIG. 2 shows the top surface view of a platform assembly according to the present invention. Platform assembly 10 includes a top surface 14. The underside of the platform assembly 10 is shown in FIG. 3 as attached to the converging edge 19 of the ironing board 15. As shown, the underside includes a first wing portion 12*a* and a second wing portion 12*b*. The platform assembly 10 includes a cover 20 with cover straps 20*a* and 20*b*. Cover straps 20*a* and 20*b* may connect through any conventional fastening device such as velcro, fasteners or a button assembly. Also another embodiment may allow for the simple tying of the cover straps in order to secure the platform assembly along with cover 20 to the conventional ironing board 15.

As shown in FIG. 3, the platform assembly engages the converging edge of the conventional ironing board and expands the surface area for use during ironing. The expanded surface area provides a convenient mechanism in order to increase the surface area for the user. The platform assembly is particularly useful in ironing shirts that may fit over the platform assembly. The platform assembly includes the wing portions 12*a* and 12*b* that extend into the sleeve areas of a typical shirt and the top surface area 14 provides for a large, flat surface to provide coverage for a significant portion of any subject shirt. Also, the platform assembly's shape allows for the user to flip the shirt fewer times than with a conventional board while providing significant coverage of larger portions of the subject shirt. The platform assembly thus reduces the required repositioning of a shirt during the ironing process as opposed to using the conventional board with the converging edge 19. Consequently, in addition to reducing the repositioning requirements, the platform assembly 10 also reduces the time associated with ironing a shirt.

Figure 4:
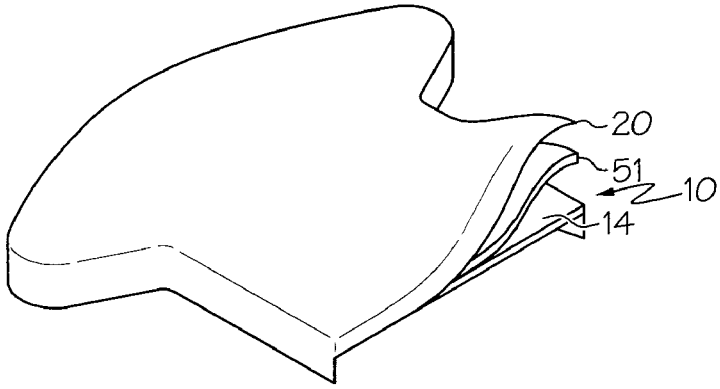
FIG. 4 shows a perspective of the layers that are associated with the platform assembly according to the present invention.

FIG. 4 shows the components of the platform assembly according to the present invention. As shown in FIG. 3, the top cover 20 covers a top pad surface 51 and the top surface 14 of the platform assembly 10. The cover 20 extends over platform assembly 10 and covers not only the platform assembly 10 but also the other portion of the conventional ironing board 15.

Figure 5A:
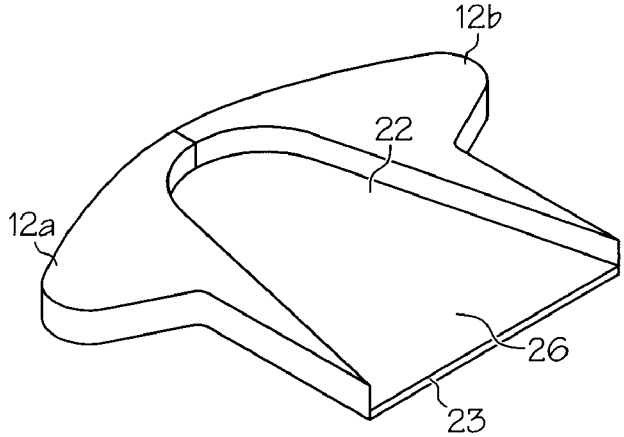
FIG. 5A shows a bottom view of the platform assembly and a cavity thereof.
Figure 5B:
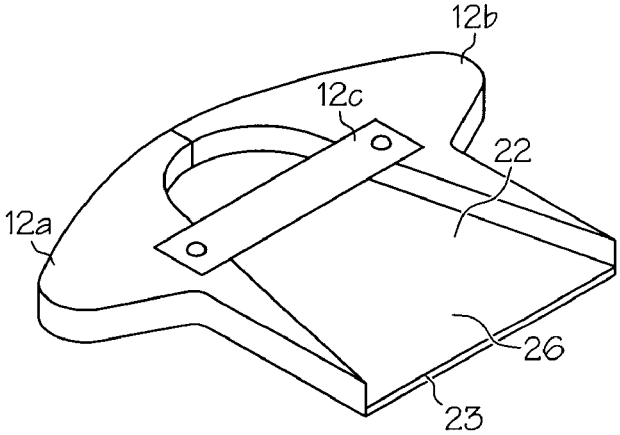
FIG. 5B shows a bottom view of the platform assembly wherein a connection member is shown across the cavity according to the present invention.

FIGS. 5A and 5B show the component portions of the platform assembly 10. As shown in both FIGS. 5A and 5B, wing portions 12*a* and 12*b* are two separate components that are joined to platform 23 of the platform assembly 10. Both wing portions 12*a*, 12*b* include upper outer edges that have a parabolic shape. The upper outside edges of the platform 23 also have a parabolic shape that aligns with the outer edges of the wing portions 12*a*, 12*b*. Once the components 12*a*, 12*b* and 23 are joined, a cavity 22 is created. The cavity 22 provides for the insertion of the converging edge 19 of a conventional ironing board. During use, the converging edge 19 abuts the outer perimeter of cavity 22. The platform 23 includes a bottom surface 26 which is substantially flat in accordance with the top surface area 14 of the platform assembly. The embodiment of FIG. 5B includes cross member 12*c* which provides another mechanism in order to secure the platform assembly to the ironing board 15. The cross member 12*c* as shown extends across cavity 22 and is adjoined to the inner portions of wing portions 12*a* and 12*b*.

Figure 5C:
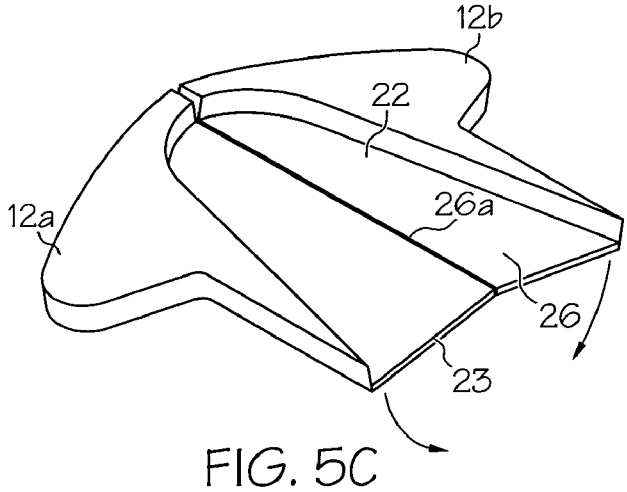
FIG. 5C shows an alternative embodiment of the platform assembly according to the present invention.

FIG. 5C shows another embodiment of the present invention. The platform assembly of FIG. 5C is essentially the same configuration of FIG. 5A, however the platform 23 includes a hinge portion 26*a* that enables the platform 23 to bend and fold as shown. A user may easily fold and store the platform assemble when not in use.

Figure 6:
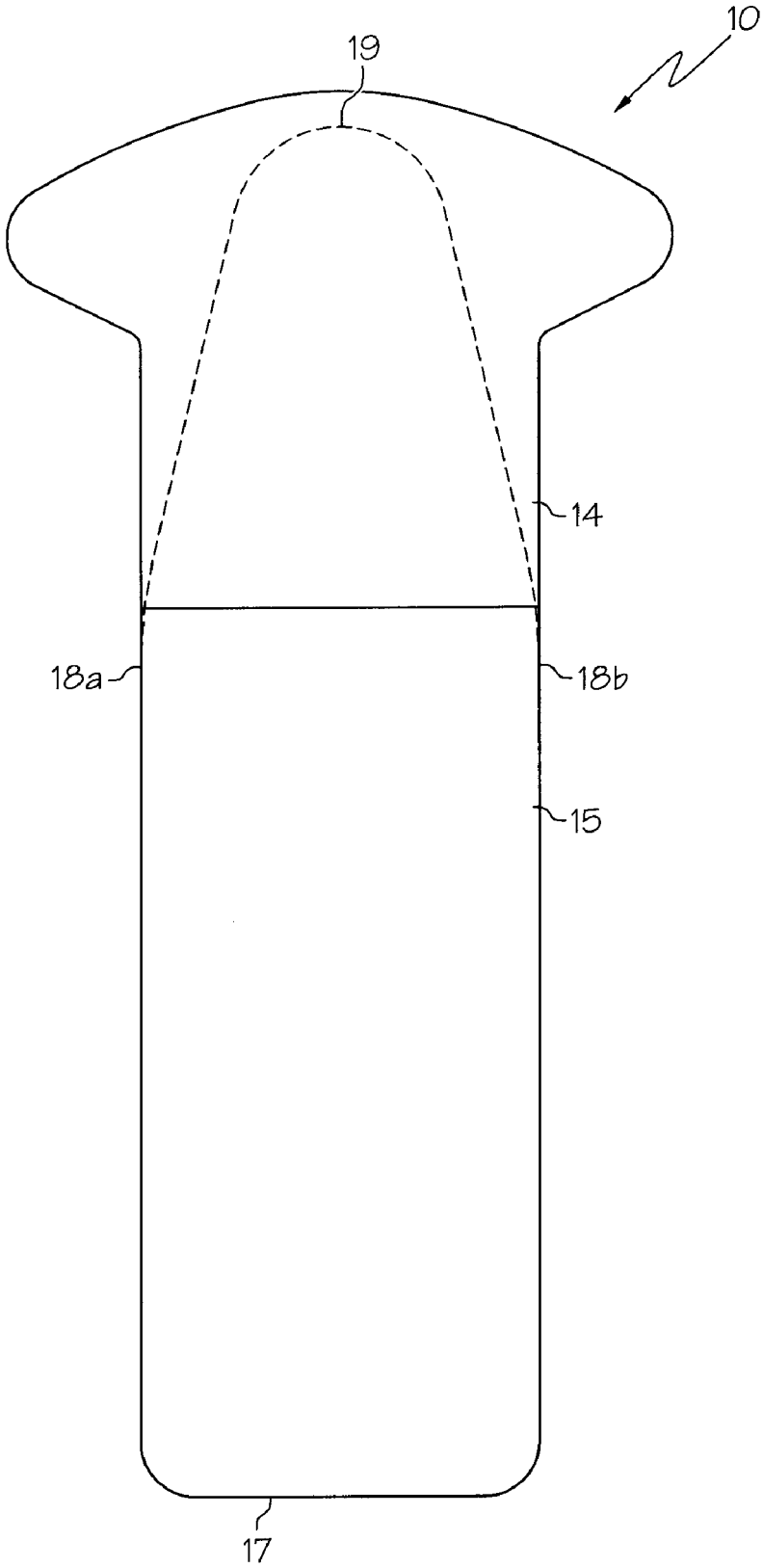
FIG. 6 shows a top view of the platform assembly on a conventional ironing board.

FIG. 6 shows a top view of the placement of platform assembly 10 onto a conventional ironing board 15. This top view merely shows the attachment of the platform assembly 10 without the placement of cover 20 over the assembly and ironing board 15. Preferably, the platform assembly 10 completely covers the converging edge 19 of the ironing board 15 also the platform assembly abuts to sides 18*a* and 18*b* in order to create a continuous straight edge that extends perpendicular to straight edge 17 of the ironing board 15. Once cover 20 is placed over the platform assembly 10 and ironing board 15, a continuous flat surface is provided for the purpose of ironing. The platform assembly ideally includes the wing portions that include parabolic outer edges that curve outwardly and extend back into the side edges 18*a* and 18*b*.

Figure 7:
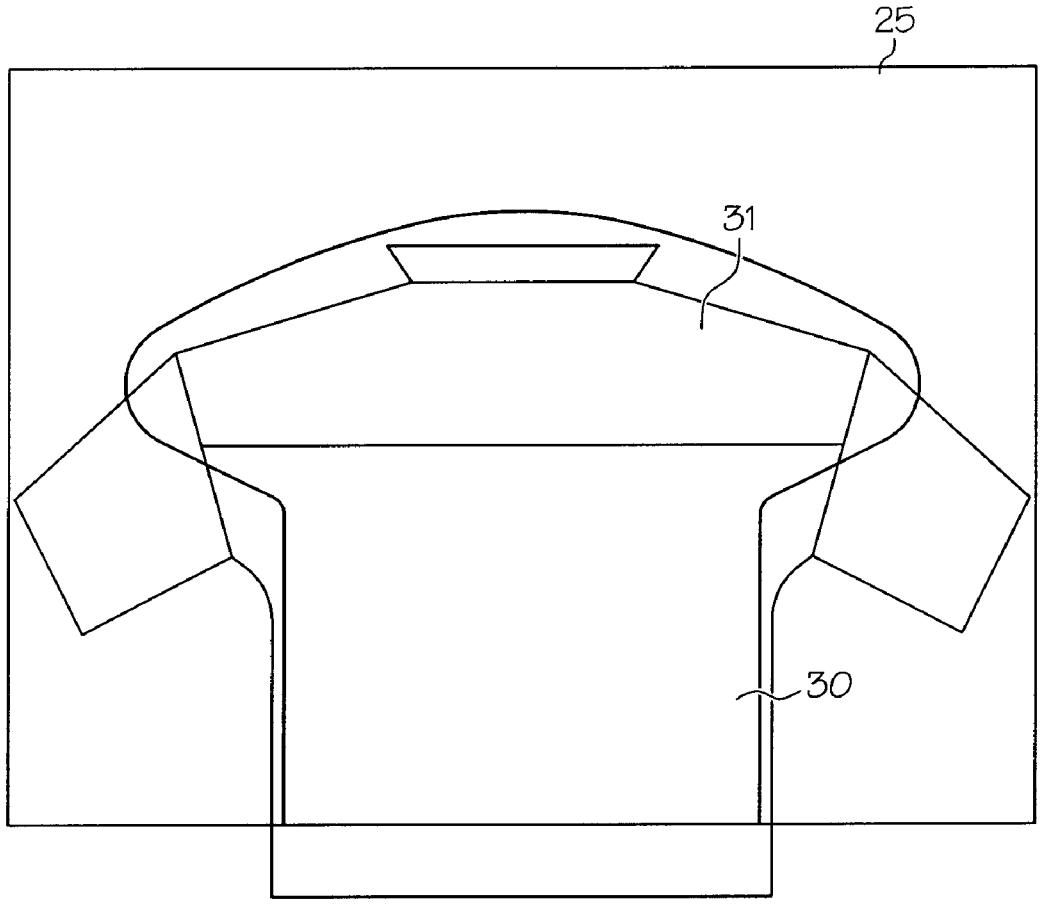
FIG. 7 shows a design template for the platform assembly according to the present invention.

FIG. 7 shows the template that may be used to create the shape of the platform assembly. As shown, template 25 includes the placement of a shirt 30 where the surrounding edges of the template to extend outwardly and follow the outer edges of the shirt 30. The template 25 then can be used to cut both the platform 23 and the wing portions 12*a*, 12*b*.

Figure 8:
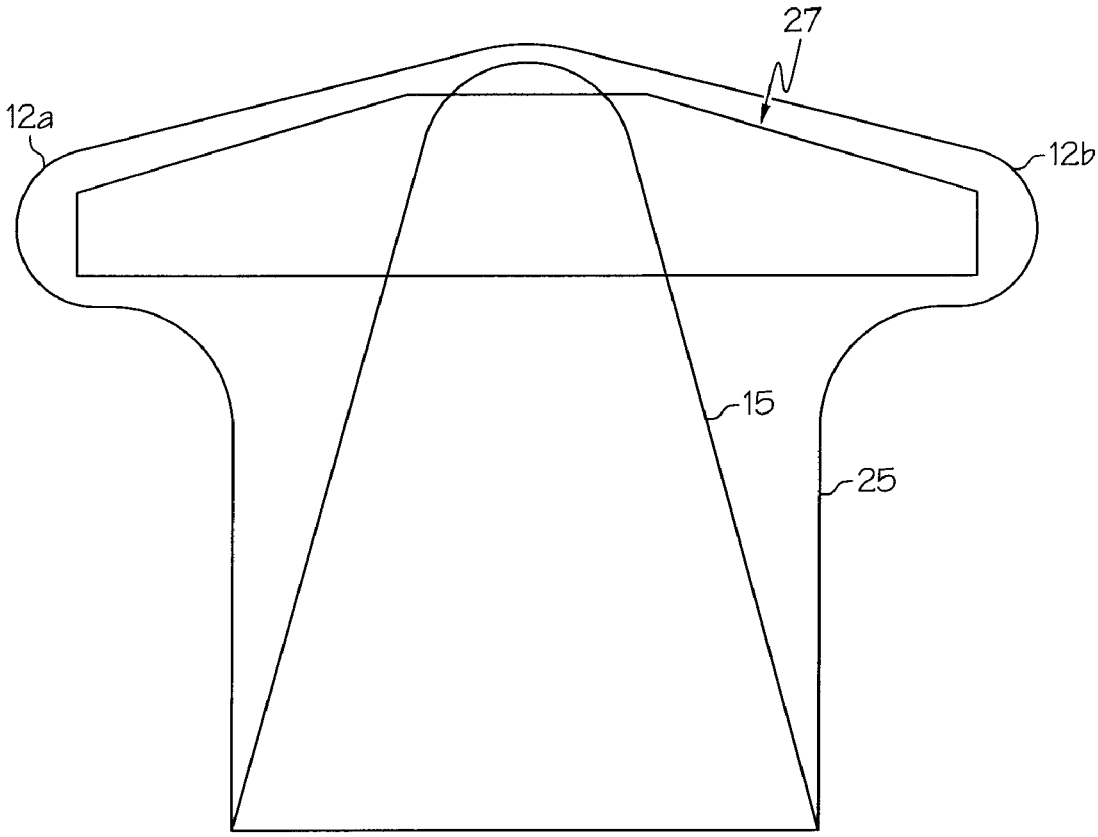
FIG. 8 shows a yoke template for the platform assembly.

FIG. 8 shows a foldaway template for use yoke portion of a shirt. Yoke template 27 enables for the customize sizing of the wing portions 12*a*, 12*b* of the platform assembly 10. By using the yoke template 27, the wing portions 12*a*, 12*b* may be shaped and configured to fit any size shirt that may conform to the yoke template 27. The yoke template 27 is essentially configured to closely match the yoke portion of a shirt such as shown in FIG. 7, yoke 31. Yoke template 27 therefore allows the customization of the platform assembly 10 to fit any size shirt.

Figure 9:
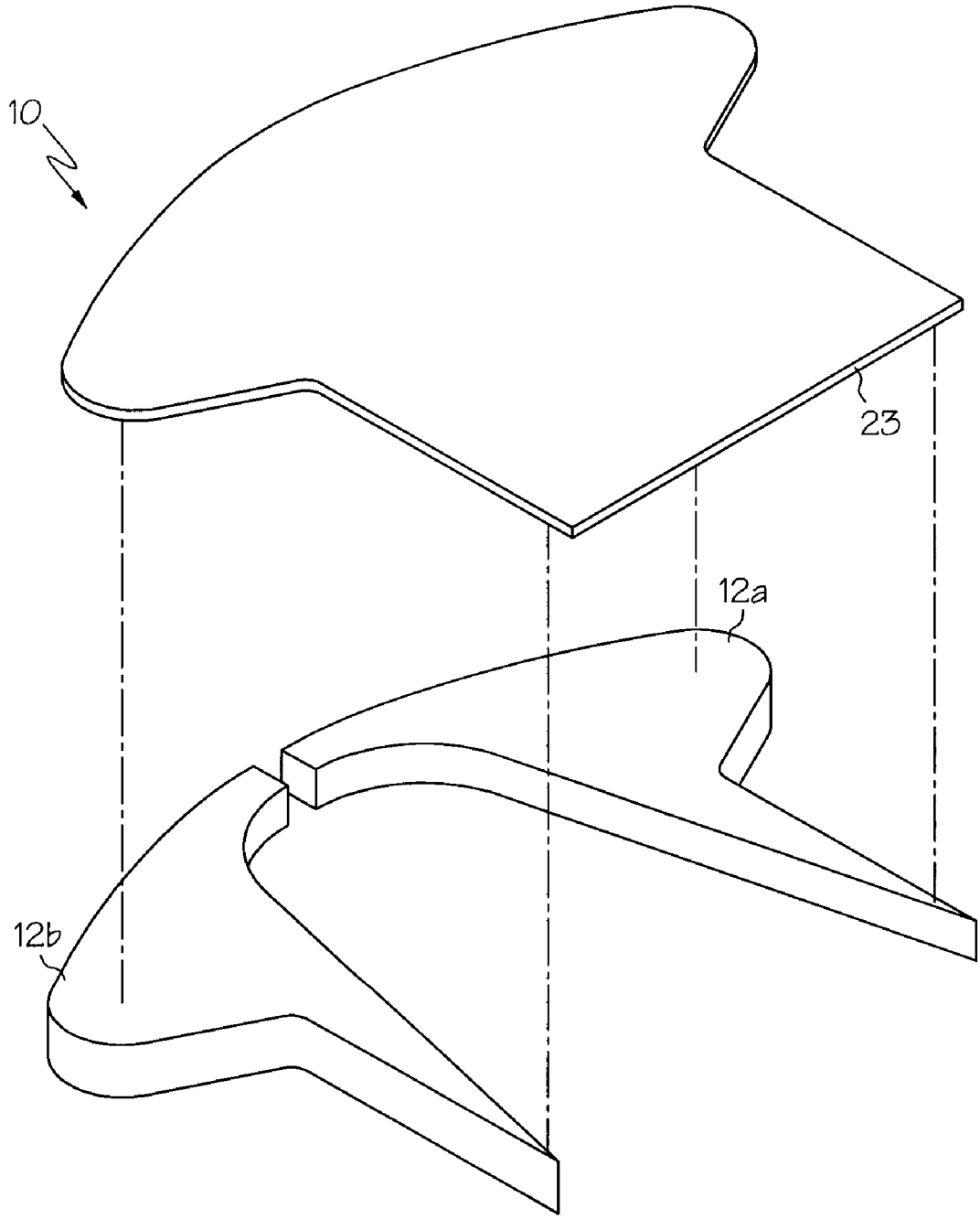
FIG. 9 shows the components of the platform assembly according to the present invention.

FIG. 9 shows an exploded view of the platform assembly 10 and wing portions 12*a*, 12*b*. As shown in FIG. 8, these components are joined together to create the complete platform assembly 10. The materials that may be associated with these various components may include wood, hardened plastic, metal or suitable fiberboard. The components may be connected by way of additional fastening components, such as screws, clamps or other fastening devices. Also, these components may be connected through use of suitable glues that may be available in order to bind these components together for a composite platform assembly 10.

Figure 10A:
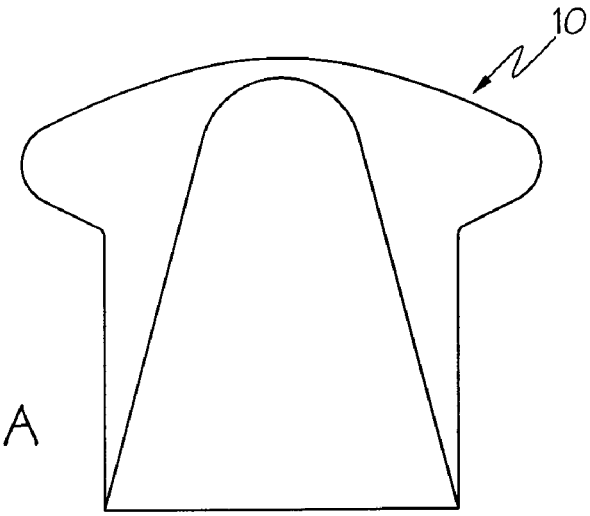
FIG. 10A shows another embodiment of the platform assembly according to the present invention.
Figure 10B:
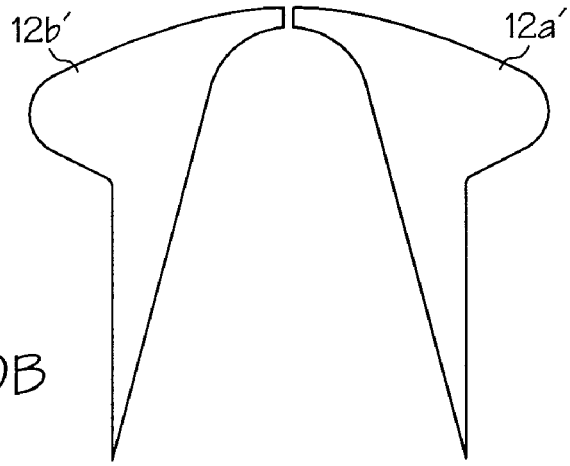
FIG. 10B shows the wing portions of the embodiment of FIG. 9A.
Figure 10C:
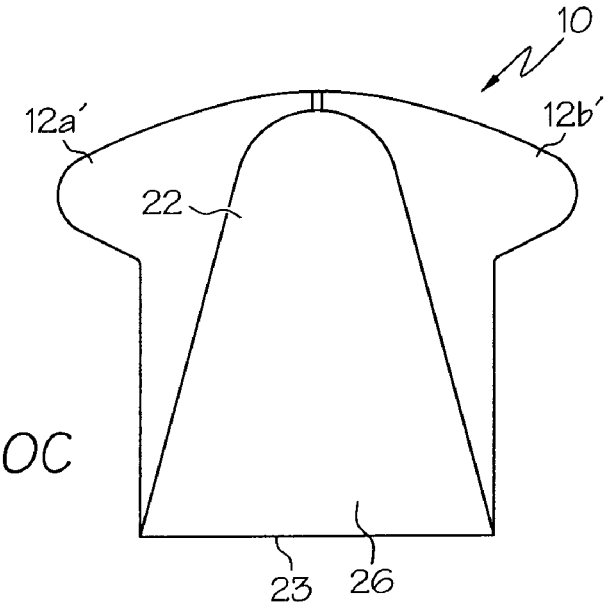
FIG. 10C shows the assembly of the components of the embodiment of FIG. 9A.

FIGS. 10A, 10B and 10C show another embodiment of the platform assembly 10 according to the present invention. The platform assembly 10 of FIGS. 9A through 9C has substantially the same shape as the above described embodiment, however, the wing portions 12*a* and 12*b* are smaller in order to extend into the sleeve area of smaller sized shirts. However, consistent with the prior embodiment, the components may be adjoined as shown in FIG. 9C, the wing portions 12*a* and 12*b* are joined to the bottom surface 26 of the platform 23 and then the cavity 22 allows for the insertion of the converging edge 19 of the ironing board.

Figure 11:
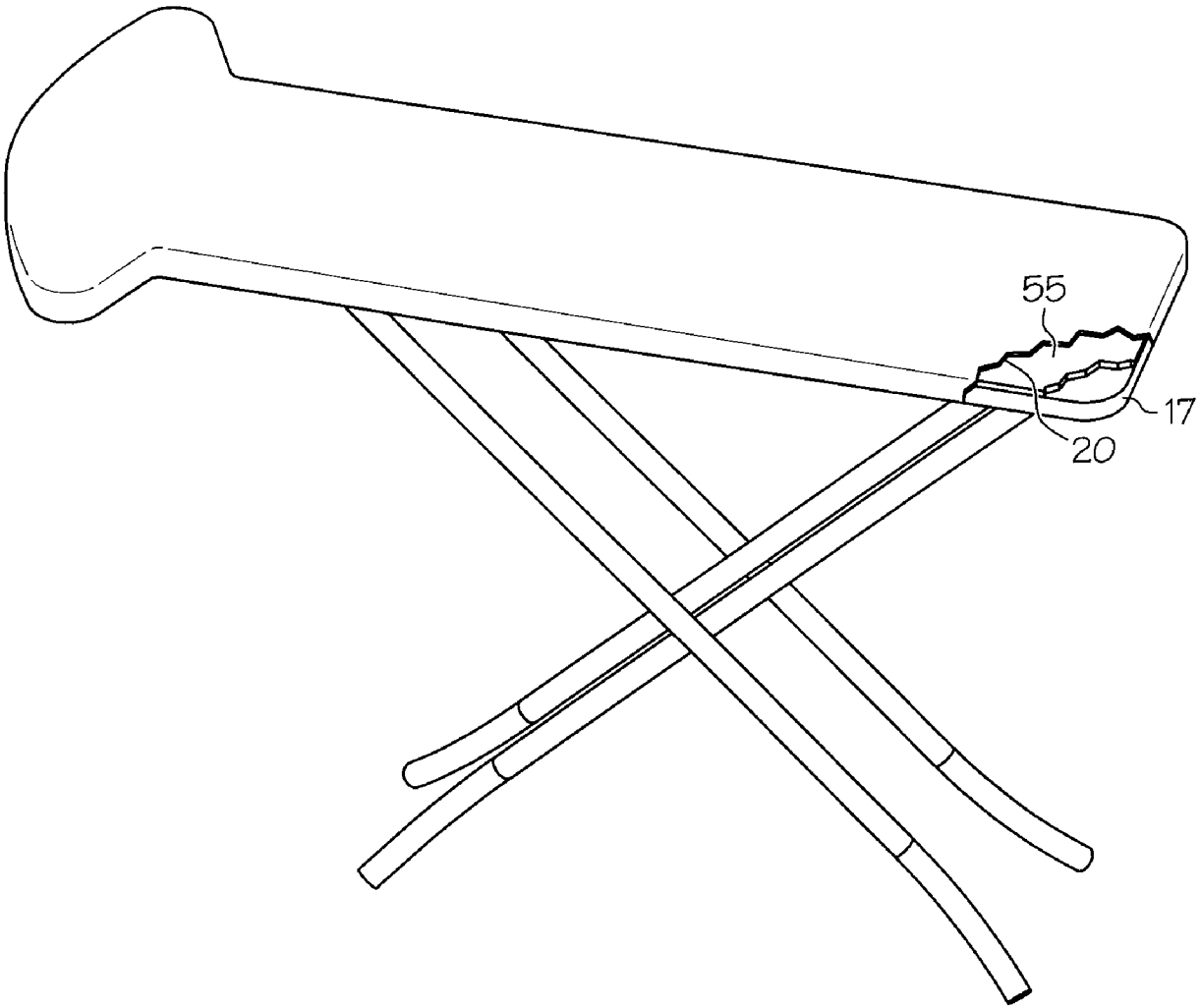
FIG. 11 shows a perspective view of the platform assembly as attached to the conventional ironing board.
Figure 12:
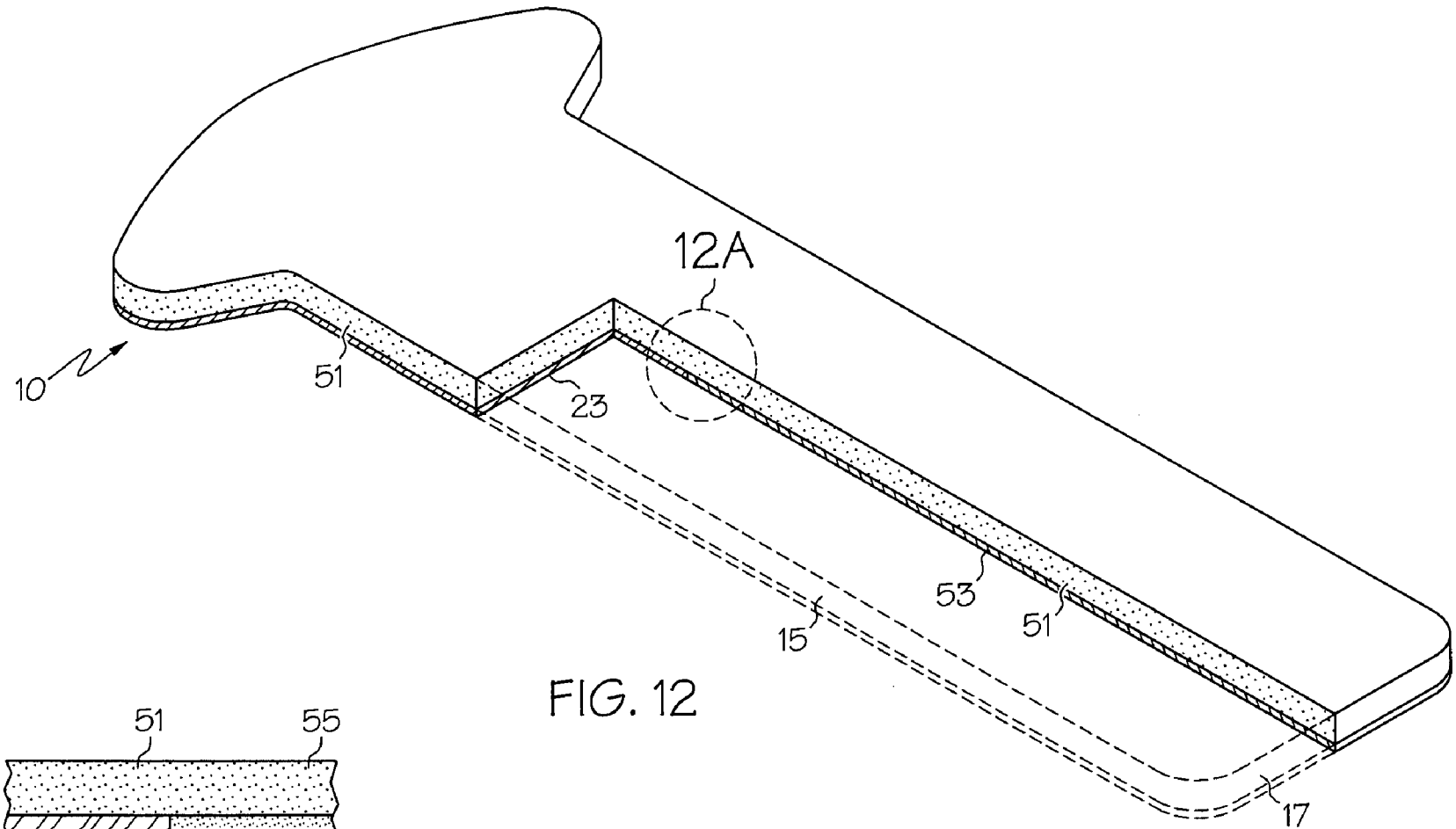
FIG. 12 shows the foam padding used in conjunction with the platform assembly according to the present invention.
Figure 12A:
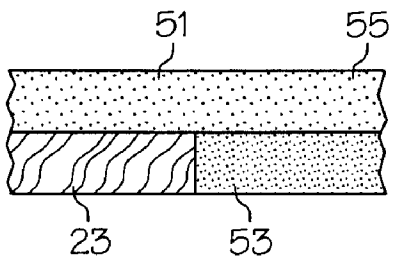
FIG. 12A shows a cut out section of the foam padding as shown in FIG. 12.

FIG. 11 shows a perspective view of the platform assembly onto a conventional ironing board. The broken off section at the straight edge 17 of the ironing board shows the ironing board is covered first with a pad 55 and then cover 20 extends over the pad 55 and extends over the platform assembly to create the composite flat surface for ironing. In order to provide for a smooth surface over the entire ironing surface, padding under cover 20 is shown in FIGS. 12 and 12A. As shown in FIG. 11, surface pad 51 extends over the platform assembly area 10 that abuts to the ironing board 15. This pad 51 extends the entire surface of the ironing board 15 to straight edge 17. Below top pad 51 is a bottom pad 53 that extends from the straight edge 17 of the ironing board into and abuts the back straight edge of the platform 23 of the platform assembly 10. Surface pad 51 provides the padding over the platform assembly 10. The padding, platform assembly 10 and iron board are all placed within the cover 20 once the platform assembly 10 has been secured to the ironing board 15.

Figure 13:
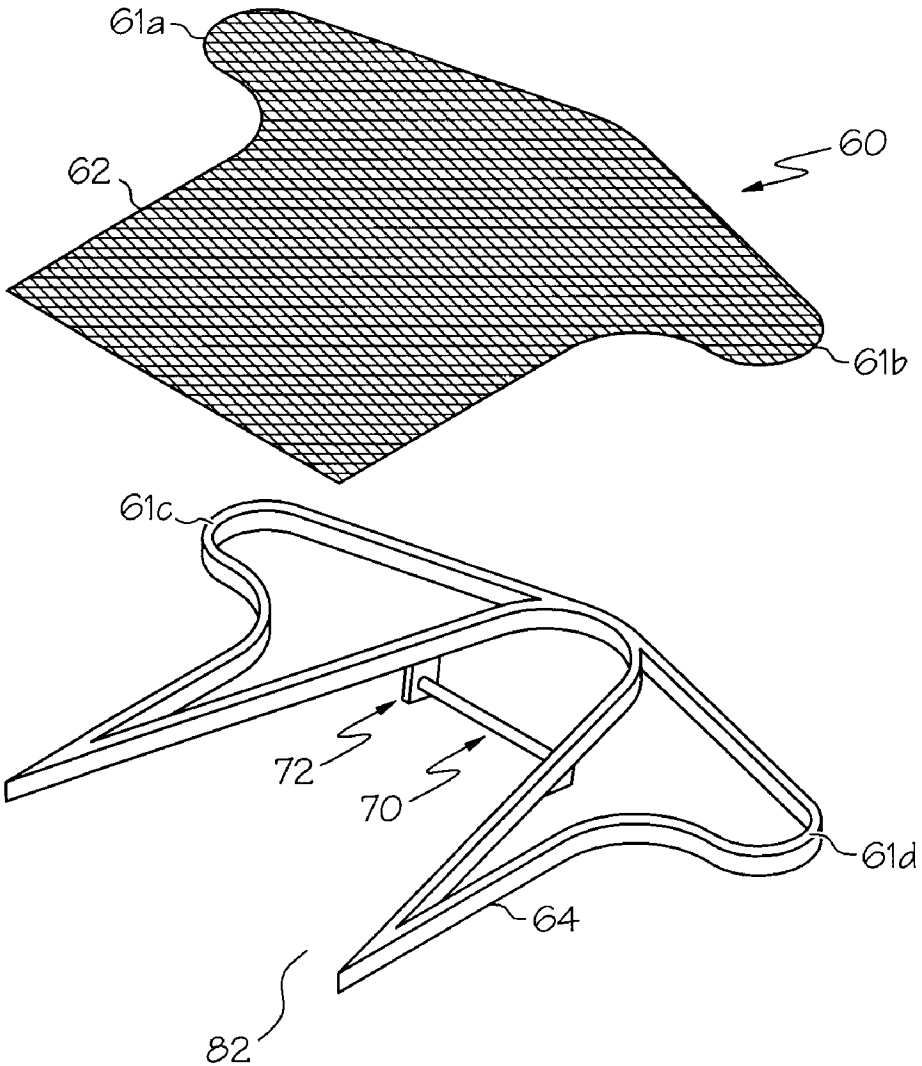
FIG. 13 shows an alternative embodiment of the platform assembly according to the present invention.

FIG. 13 shows an exploded view of an alternative embodiment of the platform assembly for the present invention. A platform surface 62 attaches over a frame portion 64 which forms a cavity 82 after attachment thereof. The under side of frame portion 64 reveals the cross member 70 attached to a cross member bracket 72. As further explained below, this embodiment enables the user to adjust the fit of the platform assembly in order to adjust for various sizes of ironing boards.

Figure 14:
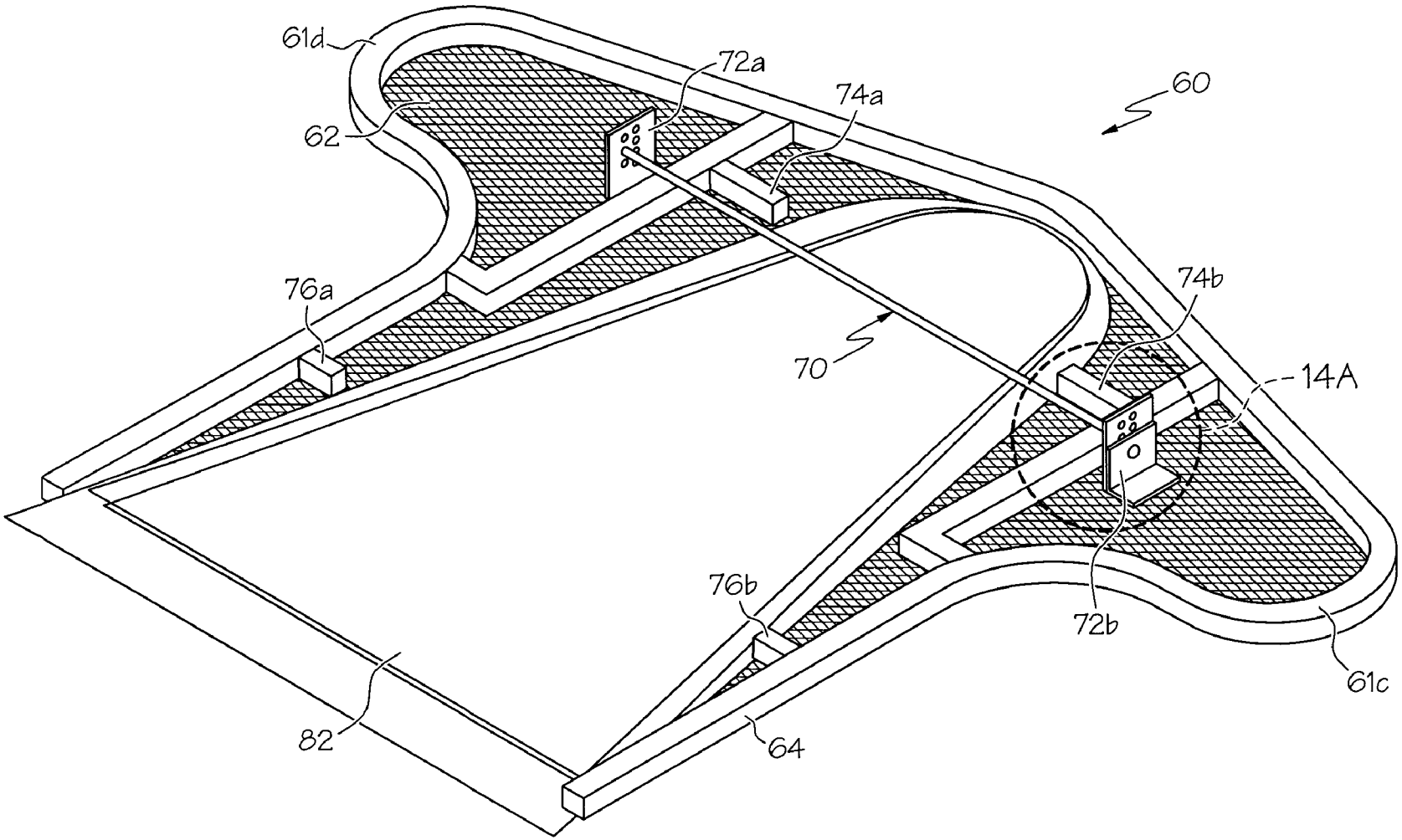
FIG. 14 shows a perspective view of the under side of the alternative embodiment of the platform assembly according to the present invention.

FIG. 14 shows a perspective view of the under side of the frame portion 64 where the platform surface 62 is attached to the upper side of the frame portion 64. Contact extensions 74*a*, 74*b* and lower contact extensions 76*a*, 76*b* extend inwardly towards cavity 82 and provide an adjustment means to insure a secure fit of the platform assembly 60. The frame portion 64 is shown as a square tubular construction in order to facilitate the movement of the contact extensions 74*a*, 74*b*. Cross member 70 extends under the cavity 82 and provides an additional means to secure the platform assembly 60 to an ironing board. Cross member 70 attaches to cross member bracket 72*a*, 72*b*. Cross member bracket 72*a*, 72*b* includes a plurality of holes respectively so as to allow a vertical adjustment means for placement cross member 70. The vertical adjustment means enables a snug fit onto the ironing board.

Figure 14A:
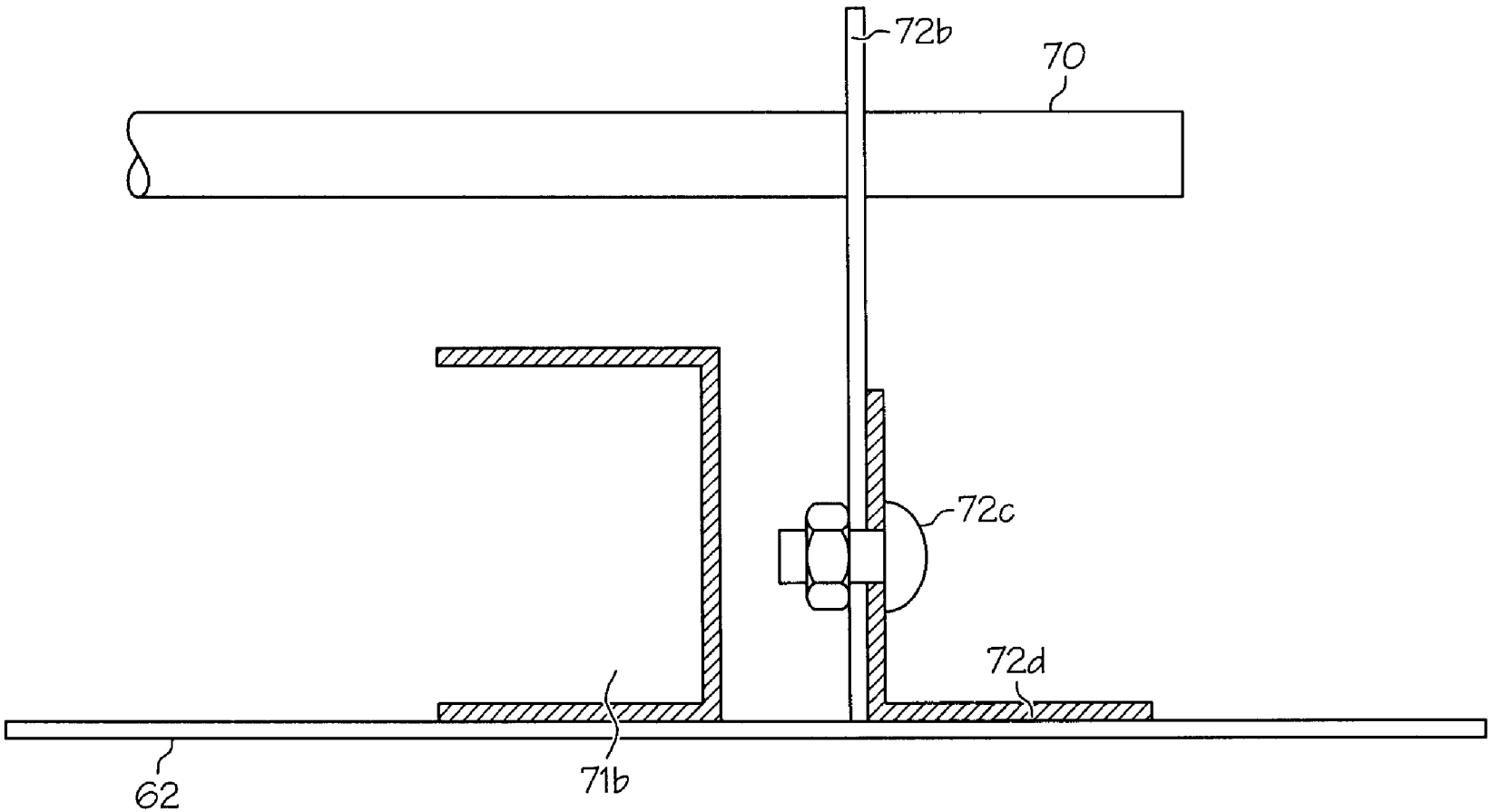
FIG. 14A shows an exploded view of the cross member bracket area.

FIG. 14A shows a detailed view of the cross member bracket area as shown in FIG. 14. One end of cross member 70 is shown extending through the cross member bracket 72*b*. The cross member bracket 72*b* attaches to an angle brace 72*d* by inserting and securing both 72*c* through the brace 72*d* and member bracket 72*b*. The angle brace 72*d* is securely attached to the under side of platform surface 62. Also attached to the under side of the platform surface 62 is an upper extension channel 71*b*. The contact extension 74*b* attaches to the extension channel 71*b* through a slot (not shown) which enables it to be adjustably maneuvered along the extension channel 71*b*. Although the present exemplary embodiment shows the brace 72*d* and channel 71*b* as being welded to platform surface 62, other means may be in place to securely attach the components, such as riveting, bolting or glue. Furthermore, the channel 71*b* and angle brace 72*d* may be formed as a composite component through molding by using a known technique known in the prior art.

Figure 15:
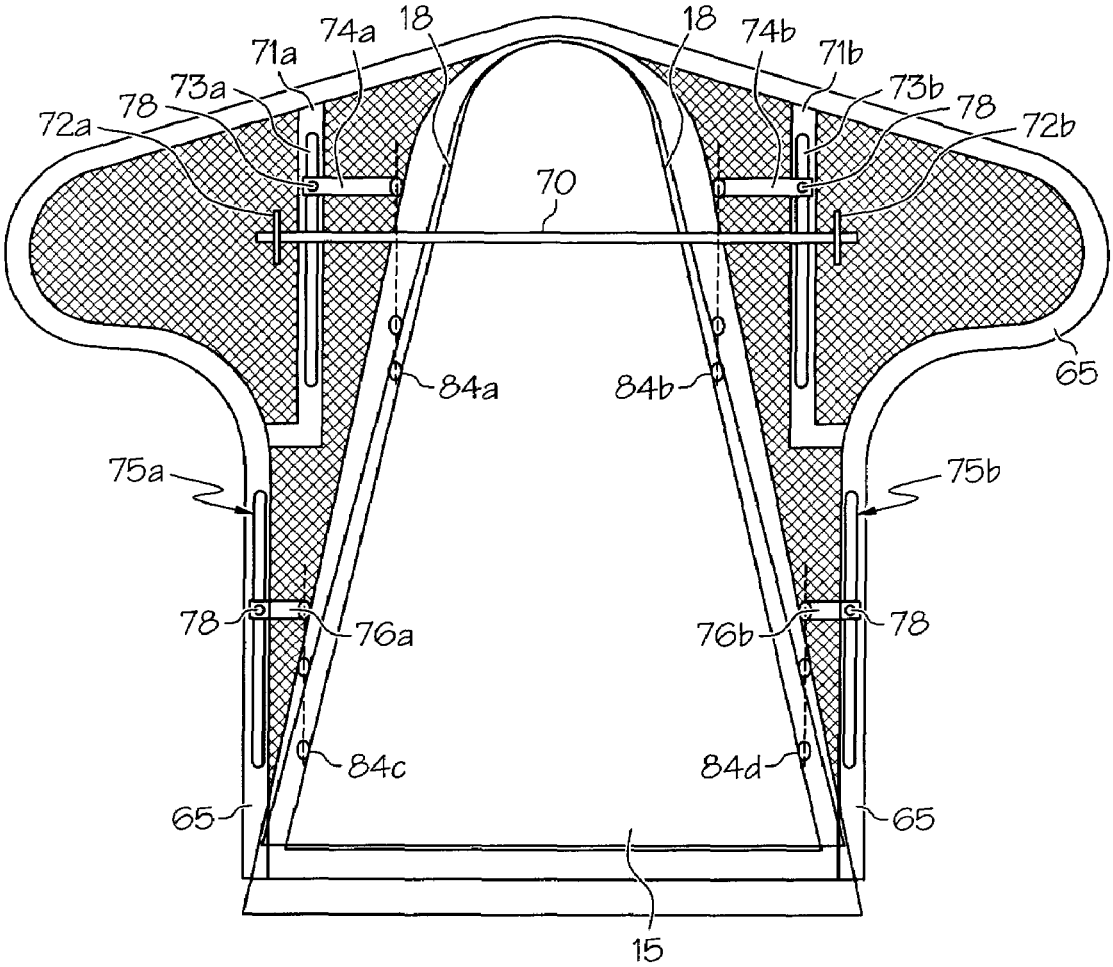
FIG. 15 shows the under side plan view of the alternative platform assembly.

FIG. 15 shows a bottom plan view of the platform assembly. The view shows movement capabilities associated with contact extension 74*a*, 74*b* and lower contact extensions 76*a*, 76*b*. The movement of the contact extensions 74*a*, 74*b*, 76*a*, 76*b* along the vertical dash lines associated with each respective extension. During use, the contact extensions retract downward until coming into a secure contact with the subject ironing board. Contact extensions are attached to slots 73*a*, 73*b*, 75*a*, and 75*b* with a locking pin 78 which locks the contact extensions into place to coincide with the size of the respective ironing board. As shown, the contact extensions travel along paths, 84*a*–84*d* and are positioned to abut the ironing board to provide resilient contact.

Figure 16:
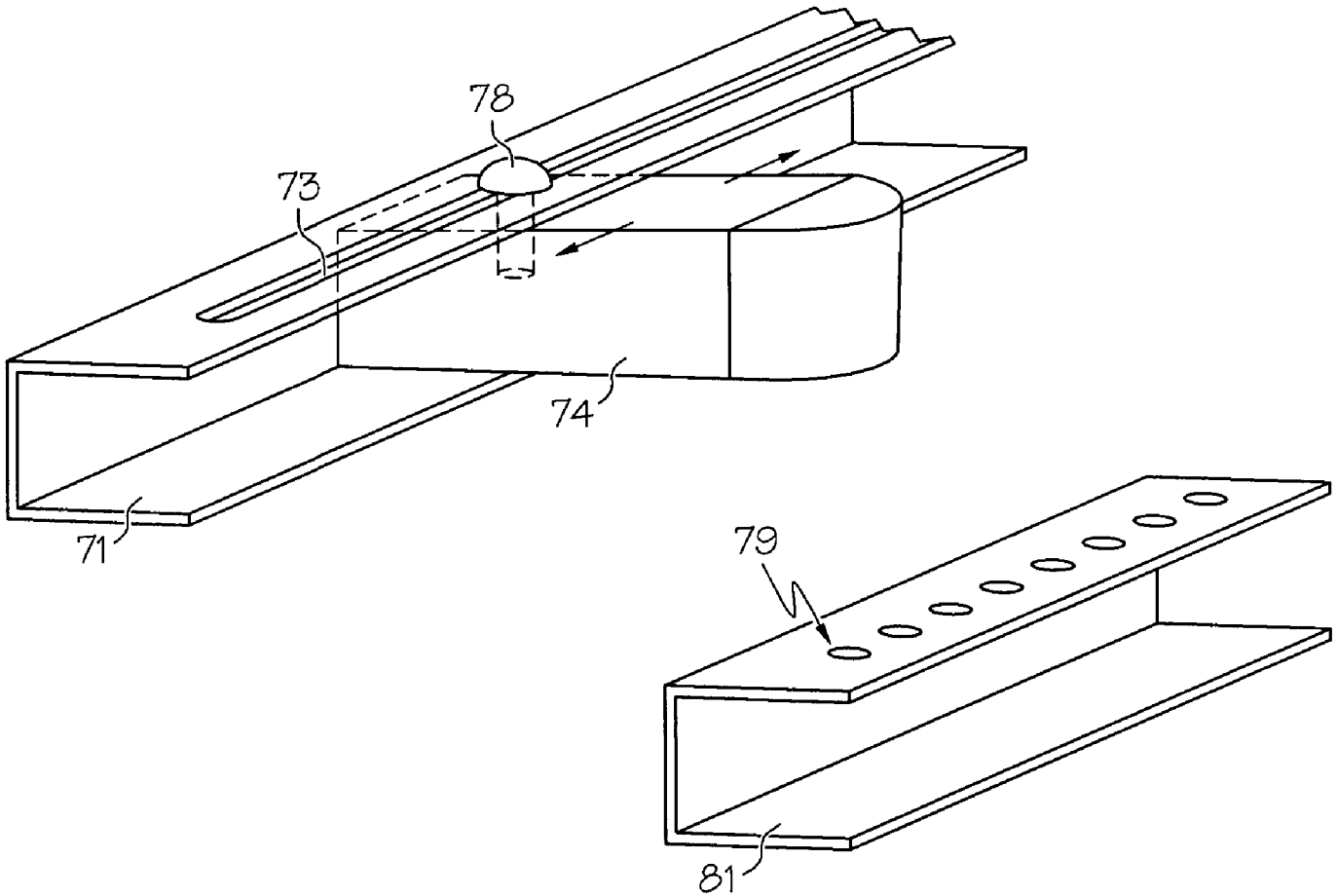
FIG. 16 shows alternative extension channels for use with the contact extensions.

FIG. 16 shows a detailed view of the extension channel 71 and contact extension 74. As shown, locking pin 78 inserts into contact extension 74 and the user merely unscrews the locking pin 78 in order to move the contact extension 74 along slot 73. Once the extension 74 is positioned into a desired position, then the user tightens locking pin 78 to secure the extension 74 into place. FIG. 16 also shows an alternate extension channel 81 which shows a plurality of holes that enable the placement of contact extension 74. The plurality of holes 79 may be used in place of the slot 73 as shown above in FIG. 16. Accordingly, this alternative channel 81 may be used in lieu of the channel 71 shown in FIGS. 15 and 16.

The instant invention has been shown and described herein in what is considered to be the most practical and preferred embodiment. It is recognized, however, that departures may be made therefrom within the scope of the invention and that obvious modifications will occur to a person skilled in the art.

What is claimed is:

1. A method for expanding the area of an ironing board surface comprising the steps of:

a. creating a tubular frame that includes a first wing portion, where said first wing portion includes an upper parabolic outer edge and a second wing portion, where said second wing portion includes an upper parabolic outer edge;

b. affixing a platform surface over the tubular frame, wherein step of affixing creates a platform assembly;

c. using an adjustment means to secure the platform assembly onto a converging end of an ironing board, where said adjustment means enables the platform assembly to securely attach to various ironing board sizes.

2. The method of claim 1 further comprising the steps of:

a. adjusting the degree that the adjustment means protrudes into a cavity formed by the tubular frame and platform assembly; and b. engaging the adjustment means into the converging sides of the ironing board.

3. A method for expanding the area of an ironing board surface comprising the steps of:

a. lying a shirt across a flat surface;

b. sketching an outline along the outside edges of said shirt's yoke, where said outline creates a template;

c. using the template to create a tubular frame, where the tubular frame includes a first wing portion and a second wing portion;

d. using the template to create a platform surface, where the platform surface includes a first wing portion and a second wing portion;

e. affixing the platform surface to the tubular frame where the outer edges of the platform surface and the tubular frame align and create a platform assembly; and f. using an adjustment means to secure the platform assembly onto a converging end of an ironing board, where said adjustment means enables the platform assembly to securely attach to various ironing board sizes.

4. The method of claim 3 further comprising the steps of:

a. adjusting the degree that the adjustment means protrudes into a cavity formed by the tubular frame and platform assembly; and b. engaging the adjustment means into the converging sides of the ironing board.

5. An expansion platform assembly comprising:

a. a tubular frame where said tubular frame includes a first wing portion, where said first wing portion includes a substantially parabolic upper outer edge and a curved inner edge said and a second wing portion, where said second wing portion includes a substantially parabolic upper outer edge and a curved inner edge;

b. a platform surface, said platform surface having symmetrical substantially parabolic upper outer edges, where the tubular frame is affixed to a first side of said platform surface, where said outer edge of said platform surface aligns with said outer edge of the tubular frame;

c. a cavity, where said cavity lies between the curved inner edges of the tubular frame and the first side of said platform surface, wherein said cavity receives an ironing board at a converging edge of said ironing board;

d. an adjustment means attached to the tubular frame where said adjustment means extends into the cavity and abuts the converging edges of the ironing board.

6. The expansion platform assembly of claim 5 further comprising:

a. contact extensions extending into the cavity, where the length of extension into the cavity may be adjusted; and b. a cross member, where said cross member extends across the cavity.

7. The expansion platform assembly of claim 6, further comprising;

a. at least two cross member brackets that support the cross member: and b. a plurality of holes in each cross member bracket which provide a vertical adjustment means for the cross member.

8. An expansion platform assembly comprising:

a. a tubular frame where said tubular frame includes a first wing portion, where said first wing portion includes a substantially parabolic upper outer edge and a curved inner edge said and a second wing portion, where said second wing portion includes a substantially parabolic upper outer edge and a curved inner edge;

b. a platform surface, said platform surface having symmetrical substantially parabolic upper outer edges, where the tubular frame is affixed to a first side of said platform surface, where said outer edge of said platform surface aligns with said outer edge of the tubular frame and forms a platform assembly;

c. a cavity, where said cavity lies between the curved inner edges of the tubular frame and the first side of said platform surface, wherein said cavity receives an ironing board at a converging edge of said ironing board;

d. at least two contact extensions extending into the cavity from the inner edges of the tubular frame; and e. a cross member extending across the cavity, where said cross member and contact extensions provide a means to securely attach the platform assembly to the converging edge of the ironing board.

* * * * *